US011396434B2

(12) United States Patent
Ishida et al.

(10) Patent No.: US 11,396,434 B2
(45) Date of Patent: Jul. 26, 2022

(54) SHEET STACKING APPARATUS AND IMAGE FORMING APPARATUS

(71) Applicant: CANON KABUSHIKI KAISHA, Tokyo (JP)

(72) Inventors: Toshiki Ishida, Nagareyama (JP); Fumihiko Hayayumi, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/776,952

(22) Filed: Jan. 30, 2020

(65) Prior Publication Data

US 2020/0165084 A1 May 28, 2020

Related U.S. Application Data

(62) Division of application No. 15/988,468, filed on May 24, 2018, now Pat. No. 10,577,203.

(30) Foreign Application Priority Data

May 31, 2017 (JP) ..... JP2017-107310

(51) Int. Cl.
*B65H 1/26* (2006.01)
*G03G 15/00* (2006.01)
*B65H 1/04* (2006.01)

(52) U.S. Cl.
CPC ..... *B65H 1/266* (2013.01); *B65H 1/04* (2013.01); *G03G 15/6538* (2013.01);
(Continued)

(58) Field of Classification Search
CPC .... B65H 1/266; B65H 1/04; B65H 2403/411; B65H 2511/20; B65H 2402/64;
(Continued)

(56) References Cited

U.S. PATENT DOCUMENTS 7,694,958 B2 4/2010 Nakamura
7,922,171 B2 4/2011 Kawamura et al.
(Continued)

FOREIGN PATENT DOCUMENTS

JP 05-178472 A 7/1993
JP 08-169563 A 7/1996
(Continued)

OTHER PUBLICATIONS

Office Action dated Mar. 9, 2021, in Japanese Patent Application No. 2017-107310.

*Primary Examiner* — Jeremy R Severson
(74) *Attorney, Agent, or Firm* — Venable LLP

(57) ABSTRACT

A sheet stacking apparatus includes a sheet stacking unit on which sheets are stacked, a sheet regulating unit, and a cover member. The sheet regulating unit includes a main body having a regulating surface regulating a position of the sheet on the sheet stacking unit, and an operating portion movably supported on the main body and having an operating surface. The operating portion is movable from a first to a second position by operating the operating surface. The sheet regulating unit is locked to the sheet stacking unit when the operating portion is in the first position, and unlocked when in the second position. The cover member includes a first surface covering the operating surface and a second surface covering an upper surface of the operating portion, and covers the operating portion with at least the first surface and the second surface so that the operating portion is not visible.

14 Claims, 15 Drawing Sheets

(52) U.S. Cl.
CPC .... *B65H 2402/64* (2013.01); *B65H 2403/411* (2013.01); *B65H 2511/12* (2013.01); *B65H 2511/20* (2013.01); *G03G 2215/00383* (2013.01)

(58) Field of Classification Search
CPC ..... B65H 2511/12; B65H 2405/1122; B65H 2405/121; G03G 15/6538; G03G 2215/00383
See application file for complete search history.

(56) References Cited

U.S. PATENT DOCUMENTS

| | | | | |
|---|---|---|---|---|
| 8,087,664 | B2 | 1/2012 | Imai | |
| 8,387,971 | B2 * | 3/2013 | Sunohara | B65H 1/266 271/171 |
| 8,523,173 | B2 | 9/2013 | Hayayumi | |
| 8,770,578 | B2 * | 7/2014 | Yamamoto | B65H 1/00 271/171 |
| 8,888,092 | B2 | 11/2014 | Hayayumi | |
| 9,254,973 | B2 | 2/2016 | Ishida et al. | |
| 9,327,924 | B2 * | 5/2016 | Ishikura | B65H 9/00 |
| 9,637,329 | B2 | 5/2017 | Hayayumi | |
| 9,714,146 | B2 | 7/2017 | Ishida et al. | |
| 10,479,627 | B2 | 11/2019 | Ishida | |
| 10,577,203 | B2 * | 3/2020 | Ishida | G03G 15/6538 |
| 2008/0001346 | A1 | 1/2008 | Meetze et al. | |
| 2009/0295072 | A1 | 12/2009 | Blair et al. | |
| 2015/0102552 | A1 | 4/2015 | Doshida | |
| 2015/0298921 | A1 | 10/2015 | Ishikura | |
| 2016/0001994 | A1 * | 1/2016 | Kuwata | B65H 7/00 271/153 |
| 2016/0001995 | A1 | 1/2016 | Sato | |
| 2016/0185540 | A1 | 6/2016 | Kaiga et al. | |
| 2016/0200531 | A1 | 7/2016 | Ishida et al. | |
| 2019/0366745 | A1 * | 12/2019 | Daniels | B65H 1/04 |

FOREIGN PATENT DOCUMENTS

| | | | |
|---|---|---|---|
| JP | 2000-007162 | A | 1/2000 |
| JP | 2005-162447 | A | 6/2005 |
| JP | 2007-217098 | A | 8/2007 |
| JP | 2010-006596 | A | 1/2010 |
| JP | 2011-016640 | A | 1/2011 |
| JP | 2015-229536 | A | 12/2015 |

* cited by examiner

SHEET STACKING APPARATUS AND IMAGE FORMING APPARATUS

BACKGROUND OF THE INVENTION

Field of the Invention

The present invention relates to a sheet stacking apparatus configured to stack sheets, and an image forming apparatus including the sheet stacking apparatus.

Description of the Related Art

In a sheet stacking apparatus such as a feed cassette to be used for an image forming apparatus, regulating members including a trailing edge regulating plate and side edge regulating plates are arranged as sheet regulating units each being configured to regulate a position of stacked sheets. In many cases, each of those regulating members includes a lock mechanism which is configured to lock the regulating members to the feed cassette and an operating portion such as a lever or a knob which releases the lock of the lock mechanism to enable the regulating member to be movable.

In Japanese Patent Application Laid-Open No. 2010-6596, there is disclosed a configuration including a trailing edge regulating member which is supported movably with respect to a feed cassette and is configured to regulate a trailing edge of each of sheets stacked in the feed cassette, a stopper which is configured to lock the trailing edge regulating member to the feed cassette, and an operation lever which is provided to operate the stopper. The operation lever is pressed in a direction away from the trailing edge of the sheet in plan view to release the lock of the trailing edge regulating member with the stopper. Through movement of the trailing edge regulating member, sheets of a plurality of sizes can be placed in the feed cassette.

In practice, the feed cassette is frequently used exclusively for one size of sheets. Therefore, there has been proposed a method of fixing a regulating member which regulates a position of a sheet to the feed cassette.

For example, in Japanese Patent Application Laid-Open No. 2011-16640, there is disclosed a side regulating member having a lock mechanism similar to a lock mechanism described in Japanese Patent Application Laid-Open No. 2010-6596. The side regulating member is fixed to the feed cassette with a screw, and only sheets of a specific size are placed in the cassette. In Japanese Patent Application Laid-Open No. 2005-162447, there is disclosed a configuration including a pair of side regulating members which is configured so as to be movable in a width direction of the sheet and regulates positions of both edges of the sheet in the width direction and lock mechanisms respectively provided to the pair of side regulating members.

Each of the operation levers disclosed in Japanese Patent Application Laid-Open No. 2011-16640 and Japanese Patent Application Laid-Open No. 2005-162447, respectively, which is configured to release the lock of the side regulating member, is exposed in a state in which the cassette is drawn out. Therefore, although the side regulating member is fixed, a user can operate the operation lever. Therefore, there is the following fear. Specifically, the user erroneously recognizes that the side regulating member is in a movable state and may forcibly move the side regulating member to break the side regulating member.

SUMMARY OF THE INVENTION

In order to solve the problem described above, the present invention has an object to provide a sheet stacking apparatus including a cover member, which is provided so as to prevent an operating portion from being erroneously operated by a user, and an image forming apparatus including the sheet stacking apparatus.

According to one embodiment of the present invention, there is provided a sheet stacking apparatus, including: a sheet stacking unit having a stacking surface on which a sheet is to be stacked; a sheet regulating unit including: a main body having a regulating surface which regulates a position of an edge of a sheet stacked on the stacking surface and being movable with respect to the sheet stacking unit; and an operating portion movably supported on a top of the main body and having a pressure surface to be subjected to a pressing operation, the operating portion being moved from a first position to a second position by performing the pressing operation on the pressure surface, the main body being regulated from moving with respect to the sheet stacking unit when the operating portion is in the first position, and the main body being allowed to move with respect to the sheet stacking unit when the operating portion is in the second position; and an opposed member removably supported on the main body and arranged so as to be opposed to at least a part of the pressure surface and an upper surface of the operating portion.

Further, according to one embodiment of the present invention, there is provided a sheet stacking apparatus, including: a sheet stacking unit having a stacking surface on which a sheet is to be stacked; a sheet regulating unit including: a main body having a regulating surface which regulates a position of an edge of a sheet stacked on the stacking surface and being movable with respect to the sheet stacking unit; and an operating portion movably supported on a top of the main body and having a pressure surface to be subjected to a pressing operation, the operating portion being moved from a first position to a second position by performing the pressing operation on the pressure surface, the main body being regulated from moving with respect to the sheet stacking unit when the operating portion is in the first position, and the main body being allowed to move with respect to the sheet stacking unit when the operating portion is in the second position; and an opposed member supported on the main body so as to be movable with respect to the main body between a proximity position being in proximity to the operating portion and a separate position being farther from the operating portion than the proximity position, and arranged so as to be opposed to at least a part of the pressure surface and an upper surface of the operating portion when the opposed member is in the proximity position.

Further, according to one embodiment of the present invention, there is provided a sheet stacking apparatus, including: a sheet stacking unit having a stacking surface on which a sheet is to be stacked; a sheet regulating unit including: a main body having a regulating surface which regulates a position of an edge of a sheet stacked on the stacking surface and being movable with respect to the sheet stacking unit; and an operating portion movably supported on the main body and having a pressure surface to be subjected to a pressing operation, the operating portion being moved from a first position to a second position by performing the pressing operation on the pressure surface, the main body being regulated from moving with respect to the sheet stacking unit when the operating portion is in the first position, and the main body being allowed to move with respect to the sheet stacking unit when the operating portion is in the second position; and an opposed member arranged on the main body and opposed to the pressure surface so as to prevent at least a part of the pressure surface from being visually recognized.

According to the present invention, the cover member is provided, and hence a user cannot operate the operating portion. Therefore, the sheet regulating unit can be fixed with a simple configuration. Further, a user does not erroneously move the sheet regulating unit, and hence breakage of the sheet regulating unit and the sheet stacking unit can be prevented.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Now, embodiments according to the disclosure of the present invention are described with reference to the accompanying drawings. In the following description, positional relationships including a vertical positional relationship, a horizontal positional relationship, and a positional relationship between a near side and a far side are described based on a state in which an image forming apparatus is viewed from a front side (from a point of view of FIG. 1).

Overall Configuration

Figure 1:
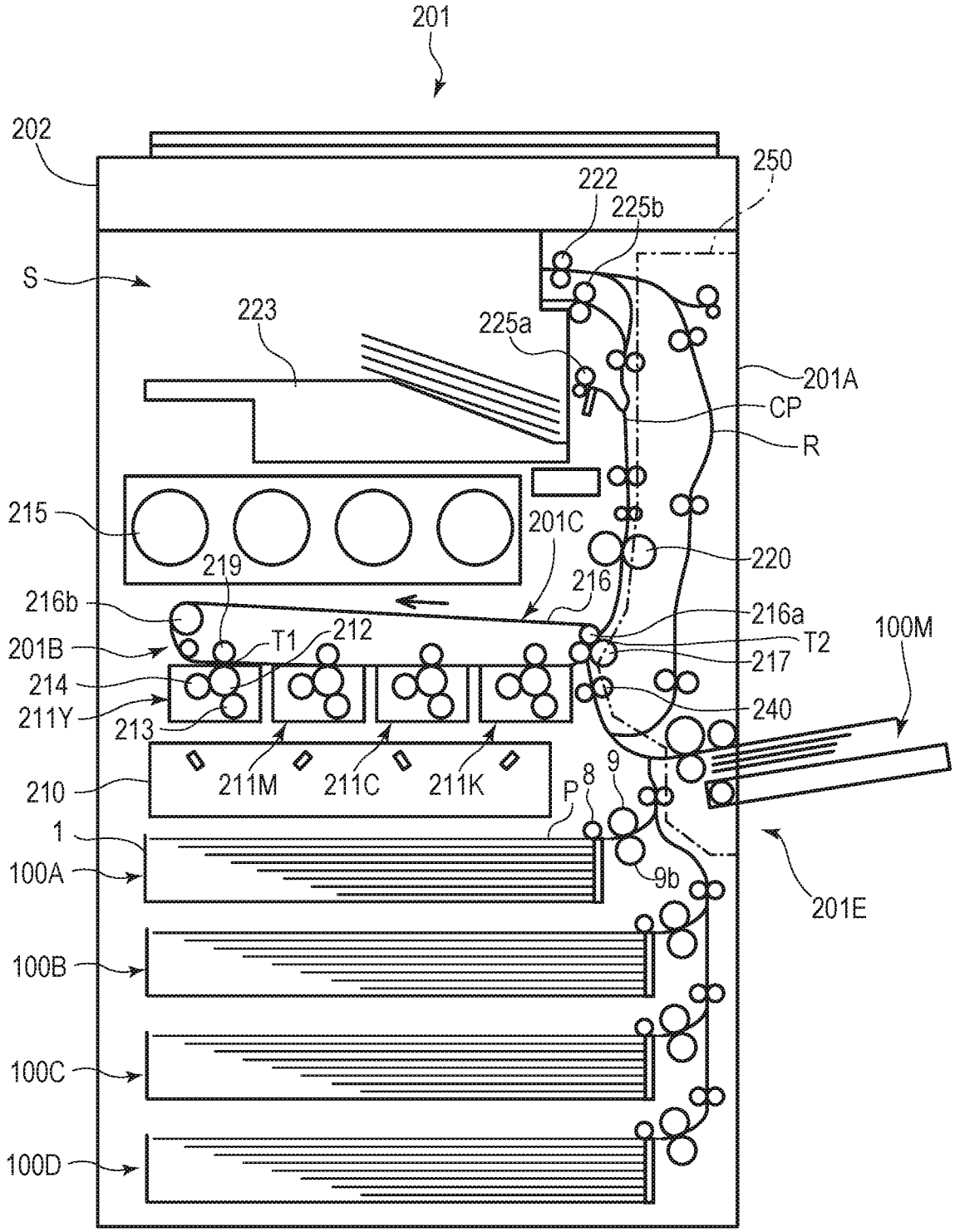
FIG. 1 is an overall schematic view for illustrating a printer according to the disclosure of the present invention.

As illustrated in FIG. 1, a printer 201 serving as an image forming apparatus is an electrophotographic full-color laser beam printer. The printer 201 includes a printer main body 201A being an apparatus main body and a reading apparatus 202, which is provided above the printer main body 201A and is configured to read image data of an original.

The printer main body 201A includes an image forming portion 201B which is configured to form an image on a sheet P and a fixing portion 220 which is configured to fix the image onto the sheet P. A delivery space S into which the sheet P is delivered is formed between the reading apparatus 202 and the printer main body 201A. In the delivery space S, a delivery tray 223 on which the delivered sheet P is stacked is provided. Further, a sheet feed portion 201E which is configured to feed the sheet P to the image forming portion 201B is provided to the printer main body 201A. The sheet feed portion 201E includes cassette feed apparatus 100A, 100B, 100C, and 100D which are arranged in a lower part of the printer main body 201A and a manual feed apparatus 100M which is arranged to a right side portion of the printer main body 201A.

A door 250 is supported on the right side portion of the printer main body 201A so as to be openable and closable. The door 250 is movable between a closed position and an open position with respect to the printer main body 201A. Through positioning of the door 250 in the open position, a conveyance path CP from the cassette feed apparatus 100A, 100B, 100C, and 100D toward the image forming portion 201B can be exposed externally. When the sheet stagnates in the conveyance path CP, the sheet can be removed by moving the door 250 to the open position.

The image forming portion 201B is a so-called four-drum full-color type image forming portion including a laser scanner 210, four process cartridges 211Y, 211M, 211C, and 211K, and an intermediate transfer unit 201C. Those process cartridges 211Y, 211M, 211C, and 211K form toner images of yellow (Y), magenta (M), cyan (C), and black (B), respectively. Each of the process cartridges includes a photosensitive drum 212, a charger 213, a developing device 214, and a cleaner (not shown). Above the image forming portion 201B, toner cartridges 215 which contain toners of the respective colors are mounted in the printer main body 201A so as to be freely removable therefrom.

The intermediate transfer unit 201C includes an intermediate transfer belt 216 which is looped over a drive roller 216*a* and a tension roller 216*b*. The intermediate transfer belt 216 is arranged above the process cartridges 211Y, 211M, 211C, and 211K. The intermediate transfer belt 216 is arranged so as to be held in contact with the photosensitive drums 212 of the respective process cartridges, and is driven to rotate in a counterclockwise direction by the drive roller 216*a* which is driven by a drive portion (not shown). The intermediate transfer unit 201C includes a primary transfer roller 219 which abuts against an inner peripheral surface of the intermediate transfer belt 216 at positions respectively opposed to the photosensitive drums 212. Primary transfer portions T1 are formed as nip portions between the intermediate transfer belt 216 and the photosensitive drums 212. The image forming portion 201B includes a secondary transfer roller 217 which abuts against an outer peripheral surface of the intermediate transfer belt 216 at a position opposed to the drive roller 216*a*. A secondary transfer portion T2 at which the toner images borne on the intermediate transfer belt 216 are transferred onto the sheet P is formed as a nip portion between the secondary transfer roller 217 and the intermediate transfer belt 216.

In each of the process cartridges, an electrostatic latent image is formed on a surface of the photosensitive drum 212 by the laser scanner 210. Thereafter, a toner image of each of the colors, which is charged to have negative polarity, is formed by supplying a toner from the developing device 214. Through application of transfer bias voltages having positive polarity respectively to the primary transfer rollers 219, the toner images are sequentially multi-layer transferred (primarily transferred) onto the intermediate transfer belt 216 at the primary transfer portions T1, thereby forming a full-color toner image on the intermediate transfer belt 216.

In parallel to the above-mentioned toner-image formation process, the sheet P fed from the sheet feed portion 201E is conveyed toward a registration roller pair 240. Skew feed of the sheet P is corrected by the registration roller pair 240. The registration roller pair 240 conveys the sheet P to the secondary transfer portion T2 at timing in accordance with timing to transfer the full-color toner image formed on the intermediate transfer belt 216. The toner image borne on the intermediate transfer belt 216 is secondarily transferred onto the sheet P at the secondary transfer portion T2 by application of a transfer bias voltage having positive polarity to the secondary transfer roller 217.

The sheet P onto which the toner image has been transferred is heated and pressurized at the fixing portion 220 to fix the color image onto the sheet P. The sheet P onto which the image has been fixed is delivered by a delivery roller pair 225*a* or 225*b* to the delivery tray 223 to be stacked thereon. For duplex printing of images on the sheet P, after passing through the fixing portion 220, the sheet P is switched back by a reverse roller pair 222 which can be rotated in a forward direction and a reverse direction. Then, the sheet P is conveyed again to the secondary transfer portion T2 through a re-conveyance path R, and an image is formed on a back surface of the sheet P.

Cassette Feed Apparatus

Next, the cassette feed apparatus 100A is described in detail. The other cassette feed apparatus 100B, 100C, and 100D which are arranged below the cassette feed apparatus 100A have the same configuration as that of the cassette feed apparatus 100A which is positioned at an uppermost level, and the description thereof is herein omitted.

Figure 2A:
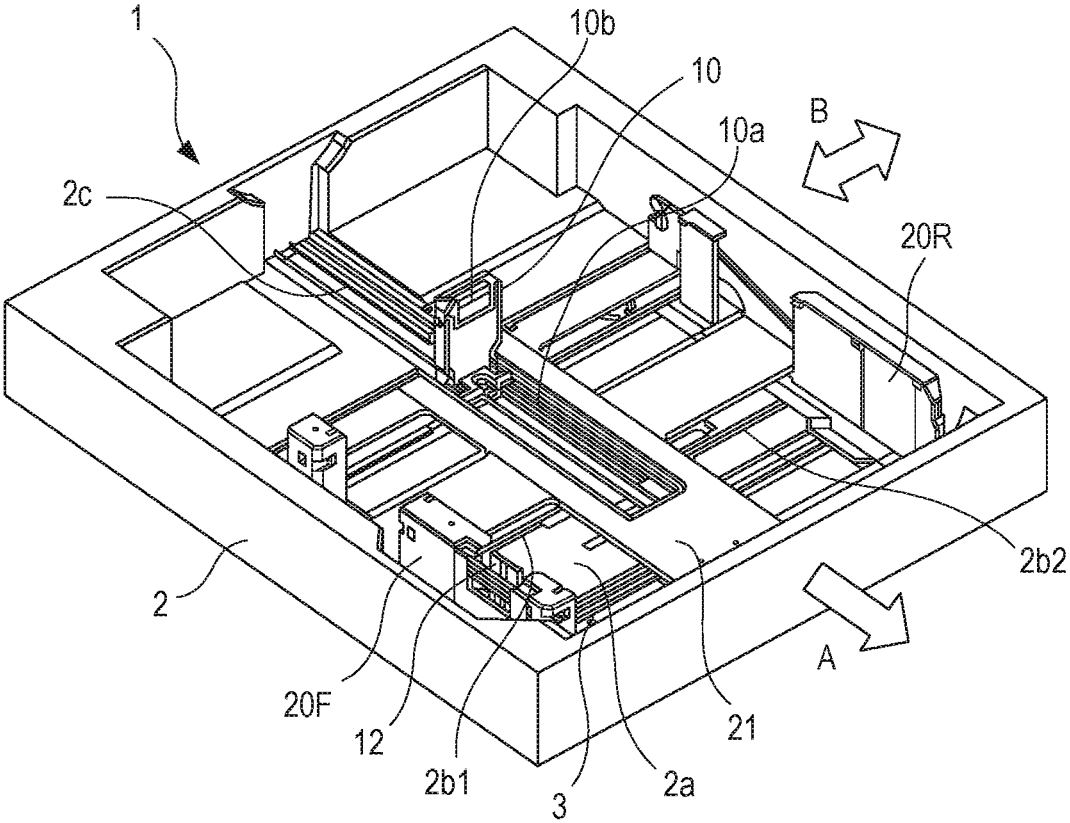
FIG. 2A is a perspective view for illustrating a feed cassette.

The cassette feed apparatus 100A includes, as illustrated in FIG. 1 and FIG. 2A, a feed cassette 1 which is supported in the printer main body 201A so as to be removable therefrom, a pickup roller 8, a feed roller 9, and a retard roller 9*b*, which are provided in the printer main body 201A. The sheet P included in sheets stacked in the feed cassette 1 is fed by the pickup roller 8 in a direction indicated by the arrow A (see FIG. 2A). The sheets including the sheet P fed by the pickup roller 8 are separated one by one by the feed roller 9 and the retard roller 9*b*. The retard roller 9*b* is connected to a torque limiter (not shown), and a drive force in a direction opposite to a direction in which the sheet P is fed is input to the retard roller 9*b*. However, the drive force is not required to be input.

Figure 2B:
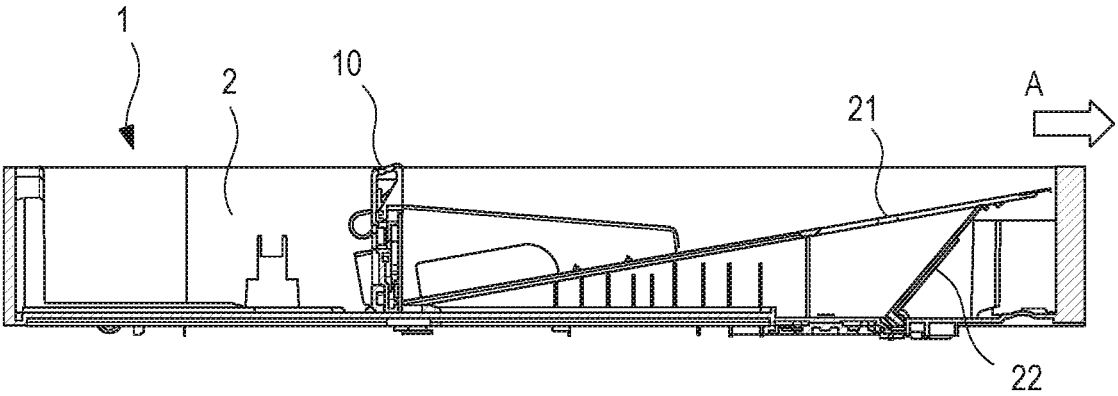
FIG. 2B is a sectional view for illustrating the feed cassette.

The feed cassette 1 serving as a sheet stacking apparatus includes, as illustrated in FIG. 2A and FIG. 2B, a cassette main body 2 serving as a sheet stacking unit in which the sheet P is received, and an intermediate plate 21 serving as a stacking surface which can be raised and lowered with respect to the cassette main body 2. The cassette main body 2 is movable in a direction indicated by the arrow B along a guide groove formed in the printer main body 201A. Through an operation of a gripping portion (not shown) provided to a front-side side surface, the cassette main body 2 can be drawn out from and inserted into the printer main body 201A. A lift arm 22 which raises and lowers the intermediate plate 21 is arranged below the intermediate plate 21. The lift arm 22 is coupled to a drive source such as a motor mounted in the printer main body 201A to be driven thereby under a state in which the cassette main body 2 is inserted into the printer main body 201A. When the image formation is performed using the sheet P received in the cassette main body 2, the lift arm 22 raises the intermediate plate 21 to a position at which sheet can be fed by the pickup roller 8. A height of an uppermost one of the sheets stacked on the intermediate plate 21 is maintained to a predetermined height by a paper-surface position detection sensor (not shown) and the lift arm 22.

In the feed cassette 1, a trailing edge regulating plate 10 and side edge regulating plates 20F and 20R which respectively regulate positions of edges of the sheet P supported on the intermediate plate 21 are arranged. The trailing edge regulating plate 10 and the side edge regulating plates 20F and 20R are supported movably on the cassette main body 2. The trailing edge regulating plate 10 and the side edge regulating plates 20F and 20R are guided by guide grooves 2*c*, 2*b*1, and 2*b*2 formed in a bottom plate 2*a* of the cassette main body 2, respectively.

Figure 3:
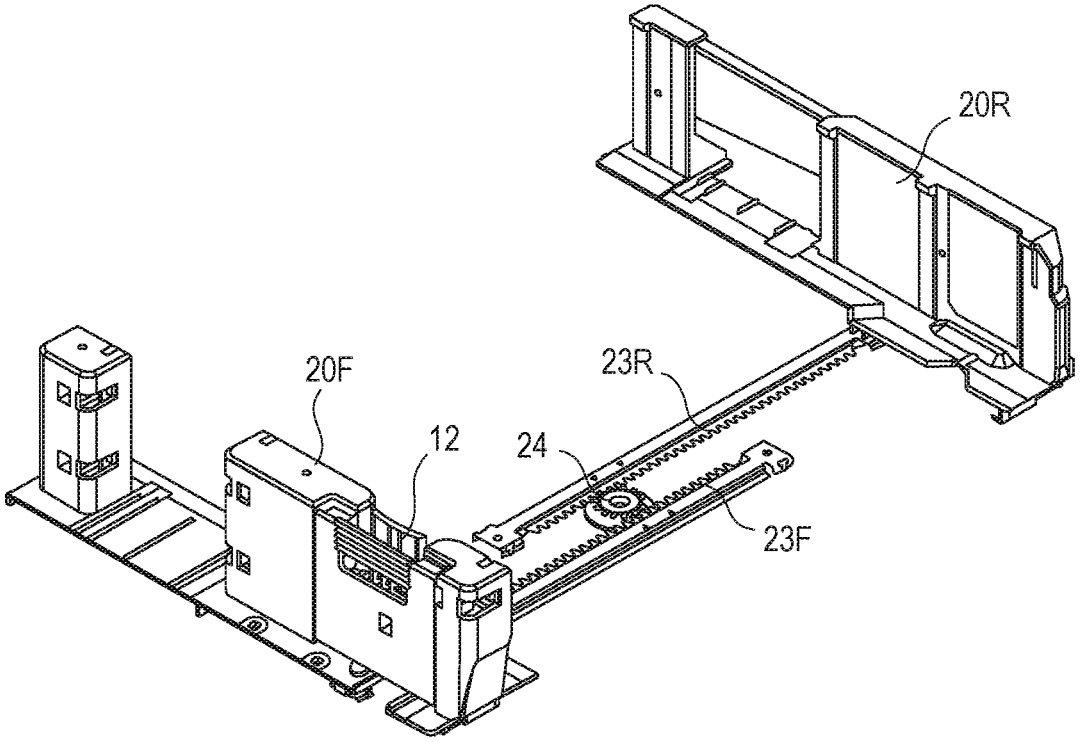
FIG. 3 is a perspective view for illustrating a pair of side edge regulating plates.

The trailing edge regulating plate 10 is movable in the direction indicated by the arrow A, which is a sheet feed direction, and can be brought into abutment against a trailing edge of the sheet P, specifically, an upstream edge of the sheet P in the sheet feed direction. The side edge regulating plates 20F and 20R are movable relatively in the direction indicated by the arrow B, which is perpendicular to the direction indicated by the arrow A being the sheet feed direction and is a cassette insertion and removal direction and a width direction, and can be brought into abutment against one edge and another edge of the sheet P, respectively. Specifically, as illustrated in FIG. 3, the side edge regulating plate 20F has a rack gear 23F extending in the width direction, whereas the side edge regulating plate 20R has a rack gear 23R extending in the width direction. Those rack gears 23F and 23R are meshed with each other through intermediation of a pinion gear 24 so as to be able to interlock with each other. The rack gears 23F and 23R and the pinion gear 24 are arranged below the bottom plate 2*a* of the cassette main body 2.

When the side edge regulating plate 20F serving as a sheet regulating unit is moved to an outer side of the cassette main body 2 in the width direction, the side edge regulating plate 20R serving as another edge regulating unit is also moved to the outer side of the cassette main body 2. When the side edge regulating plate 20F is moved to an inner side of the cassette main body 2 in the width direction, the side edge regulating plate 20R is also moved to the inner side of the cassette main body 2. In this manner, the side edge regulating plates 20F and 20R can suitably set a regulation range in the width direction of the sheet in accordance with a size of the sheet P to be used and can regulate positions of both edges of sheets of a plurality of sizes in the width direction.

As illustrated in FIG. 2A, a rack portion 10*a* having a notch-like shape for positioning the trailing edge regulating plate 10 and a rack portion 3 for positioning the side edge regulating plate 20F on a near side are formed on the bottom plate 2*a* of the cassette main body 2. A release lever 10*b* is provided to the trailing edge regulating plate 10 as an operating portion which can be operated to disengage an engagement claw from the rack portion 10*a*, whereas a release lever 12 is provided to the side edge regulating plate 20F on the near side as an operating portion which can be operated to disengage an engagement claw from the rack portion 3. For moving the trailing edge regulating plate 10 and the side edge regulating plate 20F, a user performs a pressing operation on the release levers 10*b* and 12, respectively.

Side Edge Regulating Plate

Figure 4:
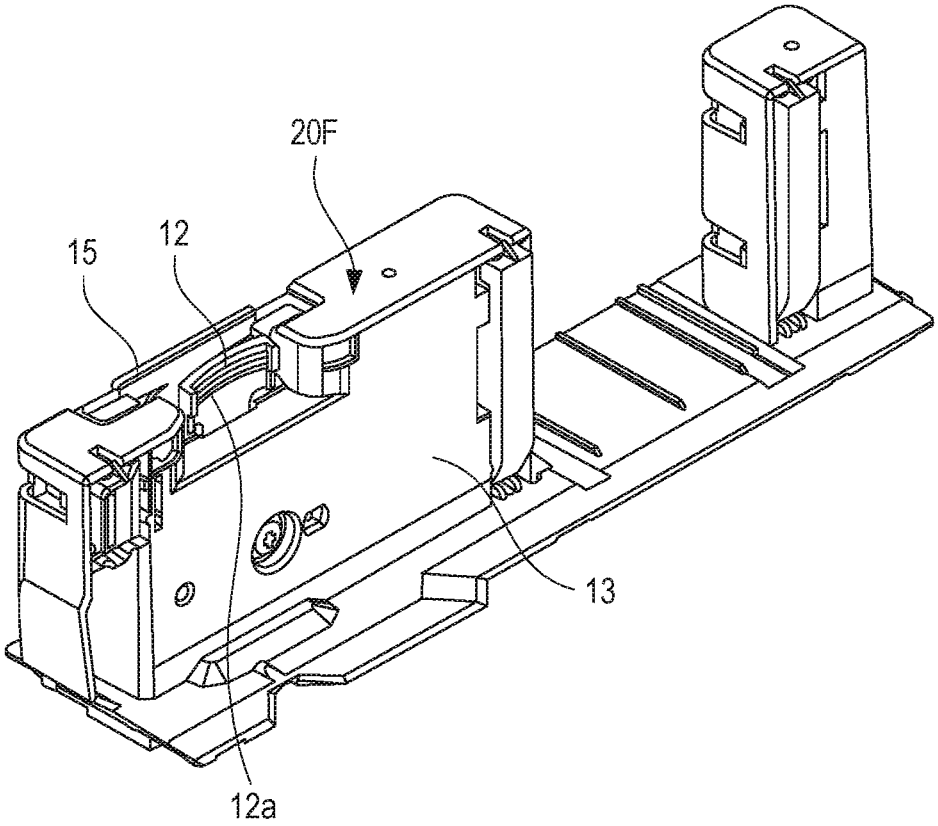
FIG. 4 is a perspective view for illustrating the side edge regulating plate on a near side.
Figure 5B:
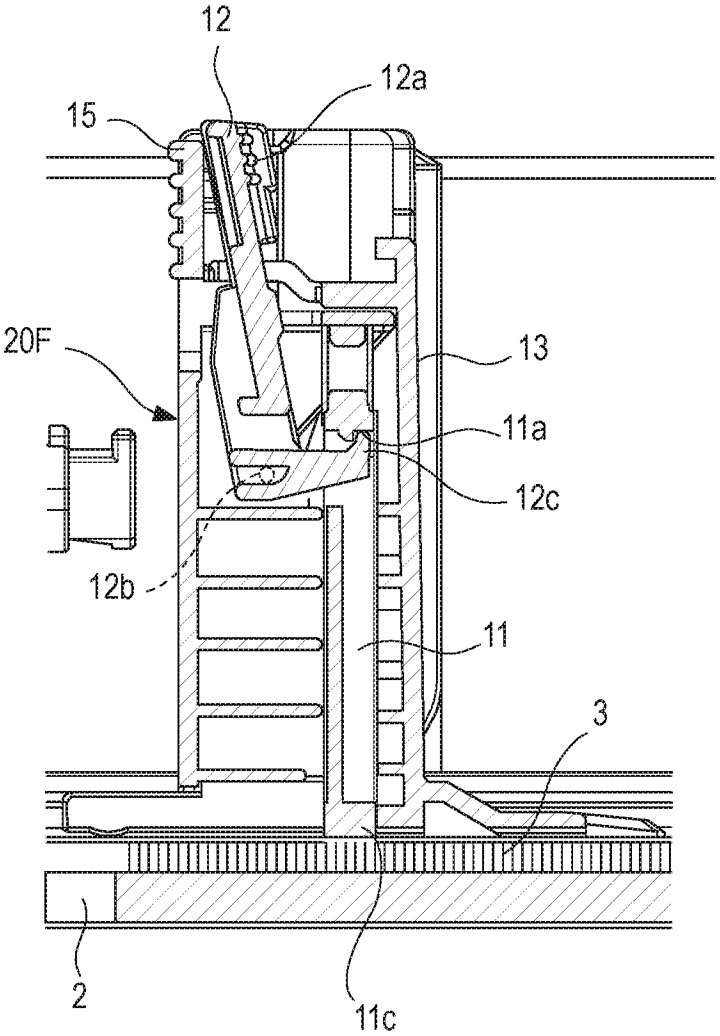
FIG. 5B is a sectional view for illustrating the side edge regulating plate in a state in which the lock member is positioned in an allowable position.
Figure 5A:
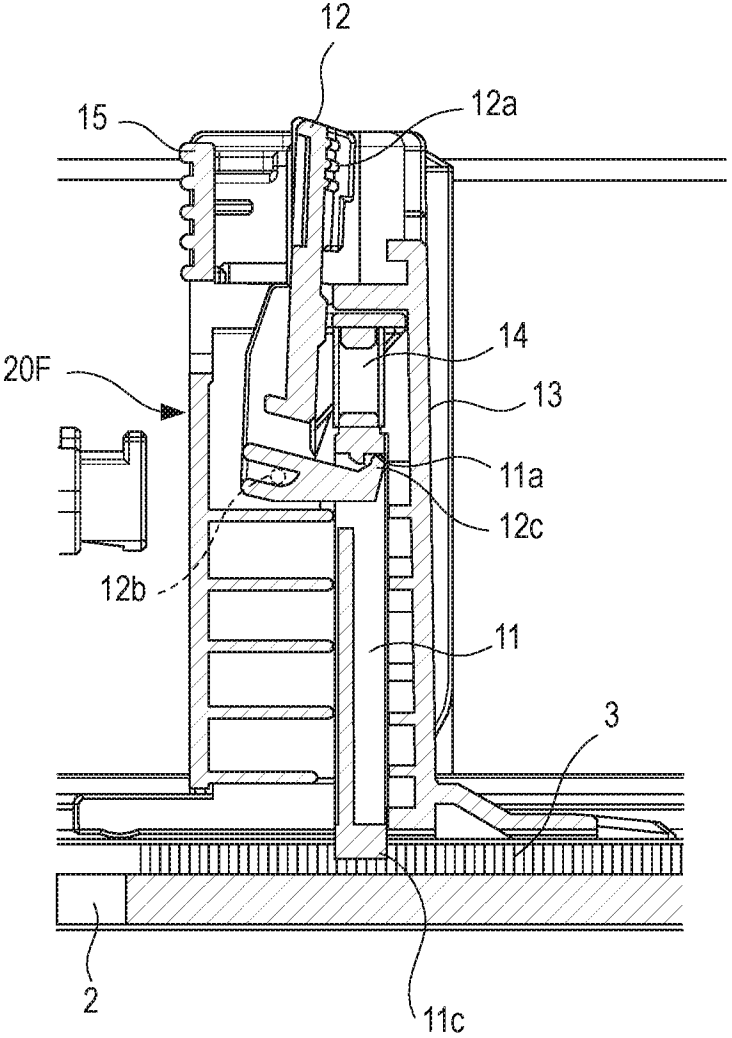
FIG. 5A is a sectional view for illustrating the side edge regulating plate in a state in which a lock member is positioned in a regulating position.

Next, the side edge regulating plate 20F on the near side is described further in detail. As illustrated in FIG. 4, FIG. 5A, and FIG. 5B, the side edge regulating plate 20F includes a regulating plate main body 15 serving as a main body, which has a regulating surface 13 to be brought into abutment against a side edge of the sheet to regulate a sheet position, and the release lever 12 which is supported pivotably by the regulating plate main body 15. The release lever 12 is supported so as to be pivotable with respect to an upper part of the regulating plate main body 15 about a pivot shaft 12*b* extending in a horizontal direction as a center, and has a pressure surface 12*a* which can be pressed by the user. Specifically, the release lever 12 pivots about the pivot shaft 12*b* as a center between a neutral position serving as a first position and a pressed position as a second position. Then, the pressure surface 12*a* is positioned on an upper surface 12*d* side (above the pivot shaft 12*b* in FIG. 5A) of the release lever 12 with respect to the pivot shaft 12*b*. In a first embodiment of the present invention, the pressure surface 12*a* is a surface having concavity and convexity with respect to a surface in the periphery thereof. The concavity and convexity allow the user to easily recognize that the pressure surface 12*a* is a portion to be pressed and prevent slipping when the pressure surface 12*a* is operated.

As illustrated in FIG. 5A and FIG. 5B, inside the regulating plate main body 15, a lock member 11 which interlocks with the release lever 12 is arranged as an engagement member which is engageable with the rack portion 3. The lock member 11 has an engaging portion 11*c* which is engageable with the rack portion 3 of the cassette main body 2 and an abutment portion 11*a* which is brought into abutment against a projecting portion 12*c* of the release lever 12. The lock member 11 is moved upward by pressing the abutment portion 11*a* with the projecting portion 12*c* of the release lever 12. A spring member 14 serving an urging member is provided in a compressed fashion between the lock member 11 and the regulating plate main body 15. The lock member 11 is urged downward.

When the release lever 12 is not operated, the lock member 11 is held by an urging force of the spring member 14 in a regulating position (position illustrated in FIG. 5A) at which the engaging portion 11*c* is engaged with the rack portion 3. At this time, the side edge regulating plate 20F is locked to the rack portion 3, and hence movement of the side edge regulating plate 20F relative to the cassette main body 2 is regulated. The release lever 12 is subjected to the urging force of the spring member 14 through the lock member 11 to be held in a neutral position serving as the first position at which the pressure surface 12*a* has a posture parallel to the regulating surface 13.

When the pressing operation is performed on the pressure surface 12*a* of the release lever 12, the release lever 12 pivots in a counterclockwise direction from the neutral position to the pressed position serving as the second position, as illustrated in FIG. 5B. In this manner, the projecting portion 12*c* of the release lever 12 presses the abutment portion 11*a* of the lock member 11 to move the lock member 11 upward against an urging force of the spring member 14. Then, the lock member 11 is moved to an allowable position at which the engaging portion 11*c* is disengaged from the rack portion 3 to allow the movement of the side edge regulating plate 20F with respect to the cassette main body 2.

Figure 6:
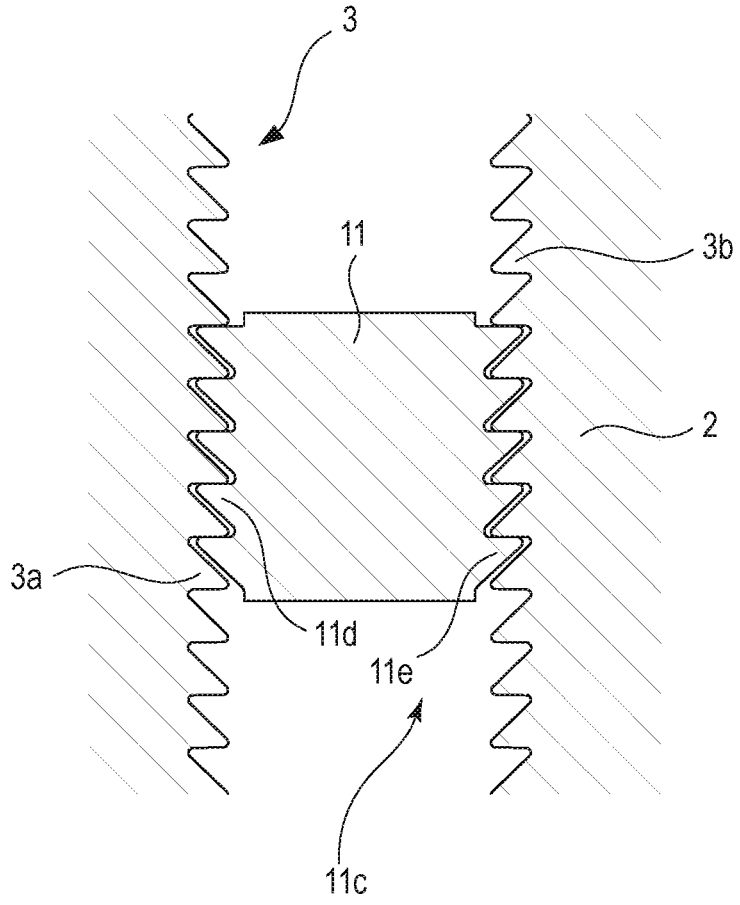
FIG. 6 is a sectional view for illustrating a rack portion of a cassette main body and an engaging portion of the lock member.

As illustrated in FIG. 6, the rack portion 3 serving as an engaged portion has a first tooth row 3*a* and a second tooth row 3*b* which are opposed to each other. The engaging portion 11*c* has a first rack 11*d* and a second rack 11*e* which can be meshed with the first tooth row 3*a* and the second tooth row 3*b*, respectively. Each of the first tooth row 3*a*, the second tooth row 3*b*, the first rack 11*d*, and the second rack 11*e* has engagement surfaces each extending in a vertical direction which is a direction of movement of the lock member 11. Then, the first rack 11*d* and the second rack 11*e* of the lock member 11 are meshed with the first tooth row 3*a* and the second tooth row 3*b*, respectively. As a result, the side edge regulating plate 20F becomes unmovable with respect to the cassette main body 2. Further, the side edge regulating plate 20F on the near side becomes unmovable with respect to the cassette main body 2, and hence the side edge regulating plate 20R on the far side, which interlocks with the side edge regulating plate 20F, also becomes unmovable. In this case, each of the first tooth row 3*a*, the second tooth row 3*b*, the first rack 11*d*, and the second rack 11*e* has the engagement surfaces each extending in the vertical direction. Therefore, even when the user intends to move the side edge regulating plate 20F in the width direction which is perpendicular to the vertical direction, the lock member 11 is not moved.

The release lever 12 is exposed under a state in which the feed cassette 1 is drawn out of the printer main body 201A. Therefore, there is a fear in that the user may unintentionally touch the release lever 12 to move the side edge regulating plate 20F. Further, for regulation of the movement of the side edge regulating plate 20F, another regulating unit is provided in addition to the release lever 12 in some cases (for example, in a case where the side edge regulating plate 20F is fixed with a screw). In this case, when the release lever 12 is visually recognized, there is a fear in that some users may erroneously recognize that the side edge regulating plates 20F and 20R are in a movable state. Thus, there is a fear in that, although the side edge regulating plate 20F is fixed with the screw, the release lever 12 is operated to forcibly move the side edge regulating plates 20F and 20R to break the side edge regulating plate 20F or 20R, or the feed cassette 1. Therefore, in the following embodiments, a cover member 51 (opposed member) is provided to the side edge regulating plate 20F to achieve a state in which it is difficult for the user to visually recognize and operate the release lever 12. In this manner, the side edge regulating plates 20F and 20R are prevented from being unintentionally moved. Further, the user is prevented from erroneously recognizing that the side edge regulating plates 20F and 20R are in a movable state, and hence the user is prevented from forcibly moving the side edge regulating plates 20F and 20R. In view of the prevention of a touch by the user, the cover member 51 may be transparent. When the user can visually recognize the release lever 12 easily, however, there is a fear in that the user may forcibly move the side edge regulating plates 20F and 20R without operating the release lever 12. Therefore, the cover member 51 may suitably be non-transparent.

First Embodiment

Cover Member and Peripheral Configuration Thereof

Figure 7:
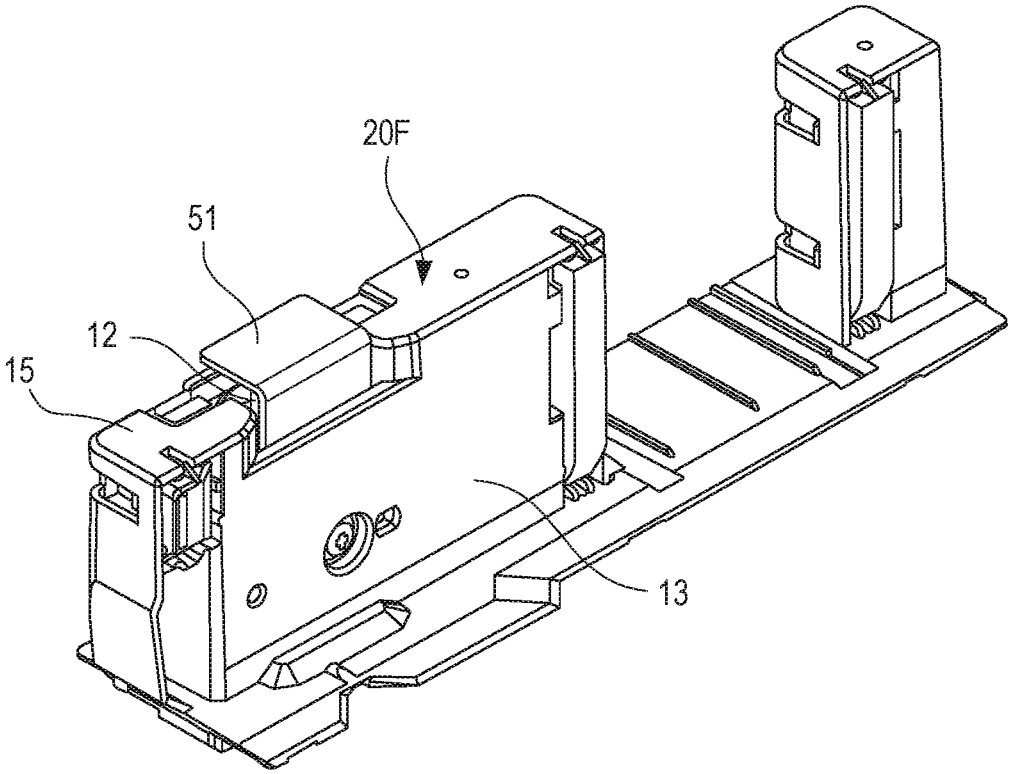
FIG. 7 is a perspective view for illustrating a side edge regulating plate and a cover member according to a first embodiment of the present invention.
Figure 8:
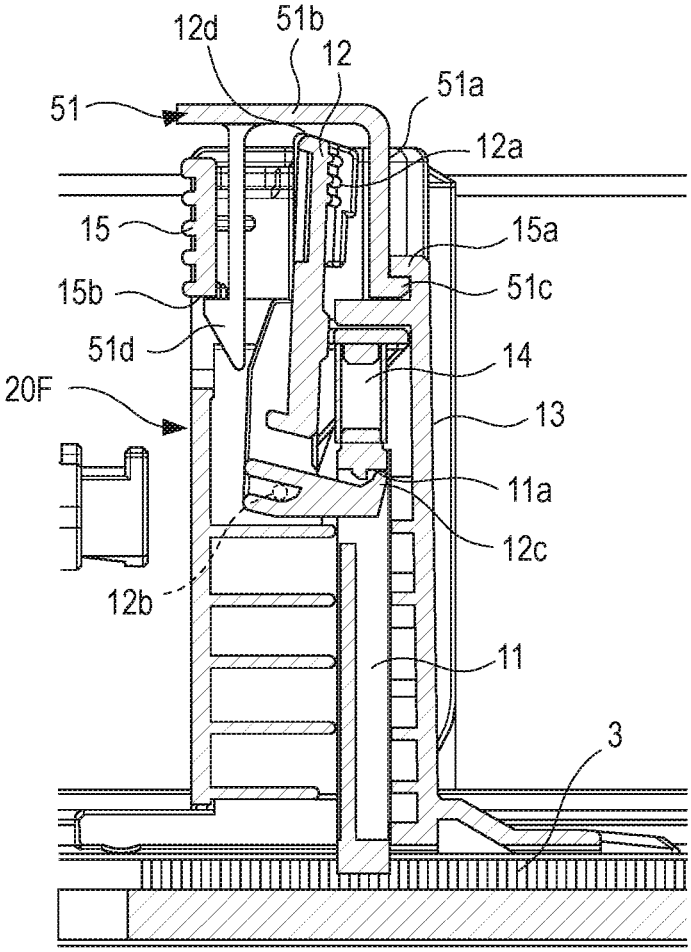
FIG. 8 is a sectional view for illustrating the side edge regulating plate and the cover member.

As illustrated in FIG. 7, the cover member 51 is provided to the side edge regulating plate 20F so as to cover the release lever 12. The cover member 51 is supported on the regulating plate main body 15 so as to be removable therefrom. As illustrated in FIG. 8, the regulating plate main body 15 includes a first locking portion 15*a* formed at an upper end of the regulating surface 13 and a second locking portion 15*b* formed on a side opposite to the regulating surface 13 through the release lever 12 therebetween. The cover member 51 has a first surface 51*a* which is opposed to the pressure surface 12*a* and a second surface 51*b* which extends outward in the width direction from an upper end of the first surface 51*a* to be opposed to the upper surface 12*d* of the release lever 12. Further, the cover member 51 includes a third locking portion 51*c* which can be locked to the first locking portion 15*a* and a fourth locking portion 51*d* which can be locked to the second locking portion 15*b*.

For mounting the cover member 51 to the regulating plate main body 15, the user first fits the third locking portion 51*c* to the first locking portion 15*a*. Thereafter, the user presses the fourth locking portion 51*d* into the regulating plate main body 15 while elastically deforming the fourth locking portion 51*d*. When the fourth locking portion 51*d* reaches the second locking portion 15*b*, the fourth locking portion 51*d* returns to an original state to be locked to the second locking portion 15*b*. The fourth locking portion 51*d* is formed into a vertically elongated shape so as to be easily elastically deformable and has a claw portion at a lower end.

Through mounting of the cover member 51 onto the regulating plate main body 15, the upper surface 12*d* and the pressure surface 12*a* of the release lever 12 are covered with the cover member 51, as illustrated in FIG. 7. In this manner, the release lever 12 can be neither operated by the user nor visually recognized by the user. More specifically, the cover member 51 prevents the user from performing a pinching operation or a pressing operation on the release lever 12 with a finger. Therefore, the user does not erroneously move the side edge regulating plate 20F and therefore can fix the side edge regulating plate 20F with respect to the cassette main body 2 with a simple configuration.

As illustrated in FIG. 8, the cover member 51 is arranged at a position farther away from the sheet than the regulating surface 13 of the regulating plate main body 15. Therefore, even when the cover member 51 is mounted onto the regulating plate main body 15, a position of the side edge of the sheet can be regulated by the regulating surface 13. For example, when the regulating plate main body 15 is desired to be moved so as to change a size of a sheet to be placed, the cover member 51 can be easily removed from the regulating plate main body 15 in a procedure in the reverse order to the procedure of mounting the cover member 51.

Second Embodiment

Next, a second embodiment of the present invention is described. In the second embodiment, an engaging part between the lock member 11 and the cassette main body 2 and the shape of the cover member 51 of the first embodiment are changed. An illustration is omitted for the same configurations as those of the first embodiment, or the same configurations are denoted by the same reference symbols in the drawings for description.

Figure 9:
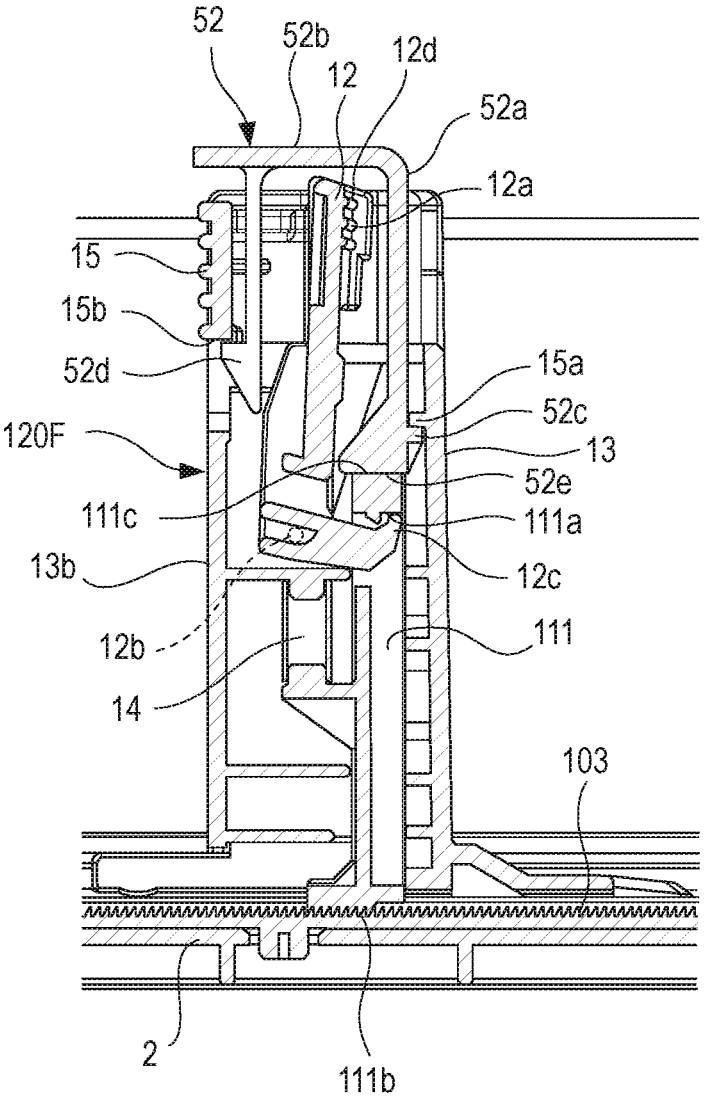
FIG. 9 is a sectional view for illustrating a side edge regulating plate and a cover member according to a second embodiment of the present invention.
Figure 10:
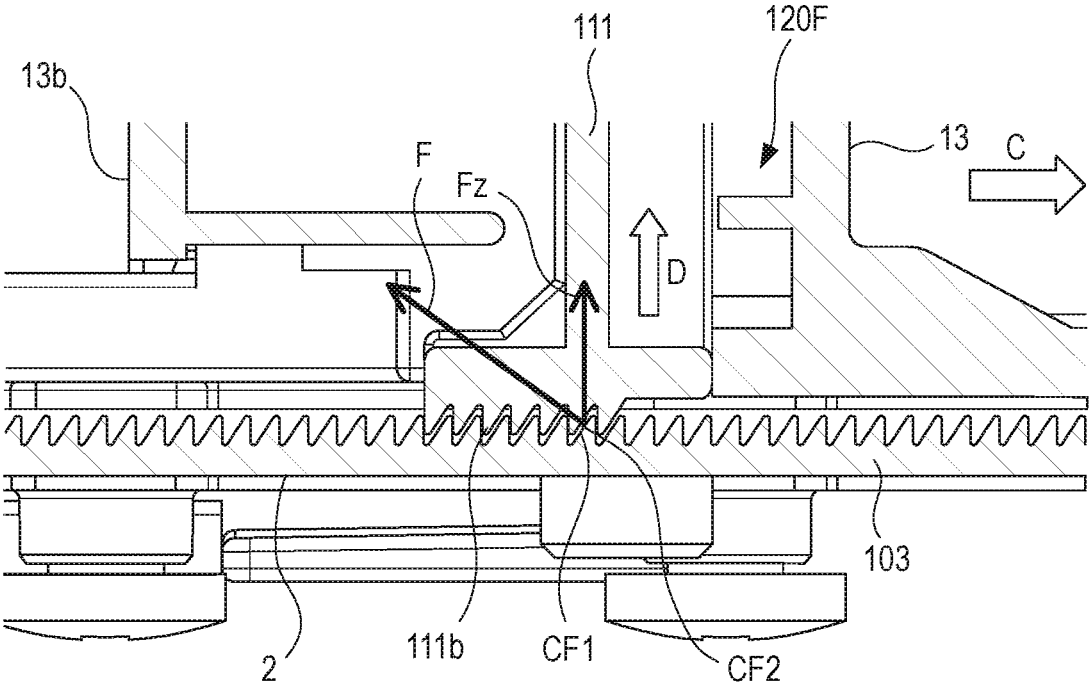
FIG. 10 is an enlarged sectional view for illustrating a rack portion of a cassette main body and a rack portion of a lock member.

As illustrated in FIG. 9 and FIG. 10, a side edge regulating plate 120F serving as the sheet regulating unit includes the regulating plate main body 15, the release lever 12, a lock member 111 serving as the engagement member, and the spring member 14. The lock member 111 has an abutment portion 111*a* which is brought into abutment against the projecting portion 12*c* of the release lever 12, a rack portion 111*b* serving as the engaging portion to be meshed with a rack portion 103 serving as the engaged portion which is formed on the bottom plate 2*a* (see FIG. 2A) of the cassette main body 2, and an upper surface 111*c*.

The rack portion 103 of the cassette main body 2 is formed to have a saw-tooth shape extending in the cassette insertion and removal direction and the width direction, and has a plurality of inclined surfaces CF1 which are inclined with respect to the vertical direction being the direction of movement of the lock member 111, as illustrated in FIG. 10. Similarly, the rack portion 111*b* of the lock member 111 is formed to have a saw-tooth shape so as to be meshed with the rack portion 103 of the cassette main body 2, and has a plurality of inclined surfaces CF2 which are inclined with respect to the vertical direction.

When the release lever 12 is moved from the neutral position to the pressed position to move the side edge regulating plate 120F outward in the width direction, a direction in which the release lever 12 is pressed and the direction of movement of the side edge regulating plate 120F match with each other. Therefore, through only the pressing operation on the pressure surface 12*a* of the release lever 12, the user can release the meshing between the rack portion 103 and the rack portion 111*b* in an interlocking manner with the release lever 12 to move the side edge regulating plate 120F in a direction opposite to a direction indicated by the arrow C.

Meanwhile, for moving the side edge regulating plate 120F in the direction indicated by the arrow C, the user presses a side surface 13*b* of the regulating plate main body 15, which is located on the side opposite to the regulating surface 13, in the direction indicated by the arrow C with a predetermined pressing force. The pressing force is converted at the inclined surfaces CF2 of the rack portion 111*b* into a force F acting on the inclined surfaces CF1 of the rack portion 103. The force F contains a force Fz being an upward component. Specifically, the pressing force is converted into the force Fz in a release direction D in which the lock member 111 is moved from the regulating position to the allowable position by the inclined surfaces CF1 of the rack portion 103 and the inclined surfaces CF2 of the rack portion 111*b*.

Then, the lock member 111 is moved to the allowable position with the force Fz, whereas the side edge regulating plate 120F is moved in the direction indicated by the arrow C by the pressing force. Therefore, only by performing the pressing operation on the side surface 13*b* of the regulating plate main body 15 in the direction indicated by the arrow C, the user can release the meshing between the rack portion 103 and the rack portion 111*b* without operating the release lever 12, thereby moving the side edge regulating plate 120F in the direction indicated by the arrow C. In this manner, the side edge regulating plate 120F can be easily moved, and hence operability can be improved.

In the second embodiment, as illustrated in FIG. 9, a cover member 52 is provided to the side edge regulating plate 120F so as to cover the release lever 12. The cover member 52 is supported on the regulating plate main body 15 so as to be removable therefrom. The cover member 52 has a first surface 52*a* which is opposed to the pressure surface 12*a*, a second surface 52*b* which is opposed to the upper surface 12*d* of the release lever 12, and a movement regulating surface 52*e* serving as a movement regulating portion which is brought into abutment against the upper surface 111*c* of the lock member 111. Further, the cover member 52 has a third locking portion 52*c* which can be locked to the first locking portion 15*a* of the regulating plate main body 15 and a fourth locking portion 52*d* which can be locked to the second locking portion 15*b*.

A configuration for mounting and removing the cover member 52 is similar to that in the first embodiment, and therefore the description thereof is herein omitted. The movement regulating surface 52*e* of the cover member 52 is brought into abutment against the upper surface 111*c* of the lock member 111 under a state in which the lock member 111 is positioned in the regulating position. Therefore, the side edge regulating plate 120F can be moved in the direction indicated by the arrow C without operating the release lever 12. Through mounting of the cover member 52 to the regulating plate main body 15, however, the movement regulating surface 52*e* of the cover member 52 retains the lock member 111 in the regulating position. In this manner, the movement of the side edge regulating plate 120F in the direction indicated by the arrow C and the direction opposite to the direction indicated by the arrow C is regulated. Thus, the side edge regulating plate 120F can be easily fixed to the cassette main body 2.

Under a state in which the cover member 52 is removed from the regulating plate main body 15, the operability of the side edge regulating plate 120F can be improved. Under a state in which the cover member 52 is mounted to the regulating plate main body 15, the side edge regulating plate 120F can be reliably fixed.

In the second embodiment, the inclined surfaces are formed on both the rack portion 103 of the cassette main body 2 and the rack portion 111*b* of the lock member 111. However, the formation of the inclined surfaces is not limited thereto. The inclined surfaces are only required to be formed on at least one of the rack portions 103 and 111*b*.

The movement regulating surface 52*e* is not limited to be brought into abutment against the upper surface 111*c* of the lock member 111, and may be brought into abutment against any portion of the lock member 111 as long as the movement of the lock member 111 to the allowable position is regulated. Further, the cover member of the first embodiment may have the movement regulating surface.

Third Embodiment

Next, a third embodiment of the present invention is described. In the third embodiment, the cover member 51 of the first embodiment is slidable. An illustration is omitted for the same configurations as those of the first embodiment, or the same configurations are denoted by the same reference symbols in the drawings for description.

Figure 11A:
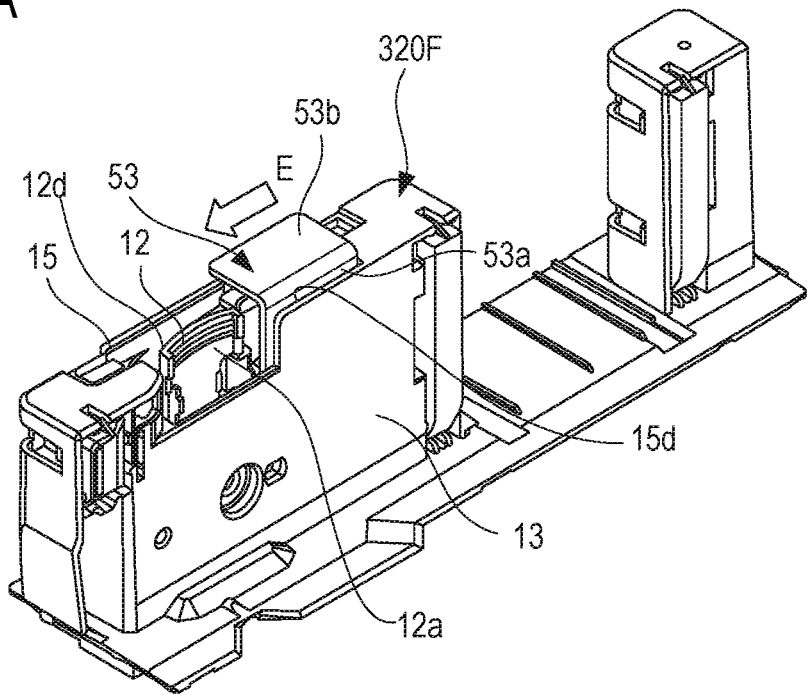
FIG. 11A is a perspective view for illustrating a cover member according to a third embodiment of the present invention.
Figure 11B:
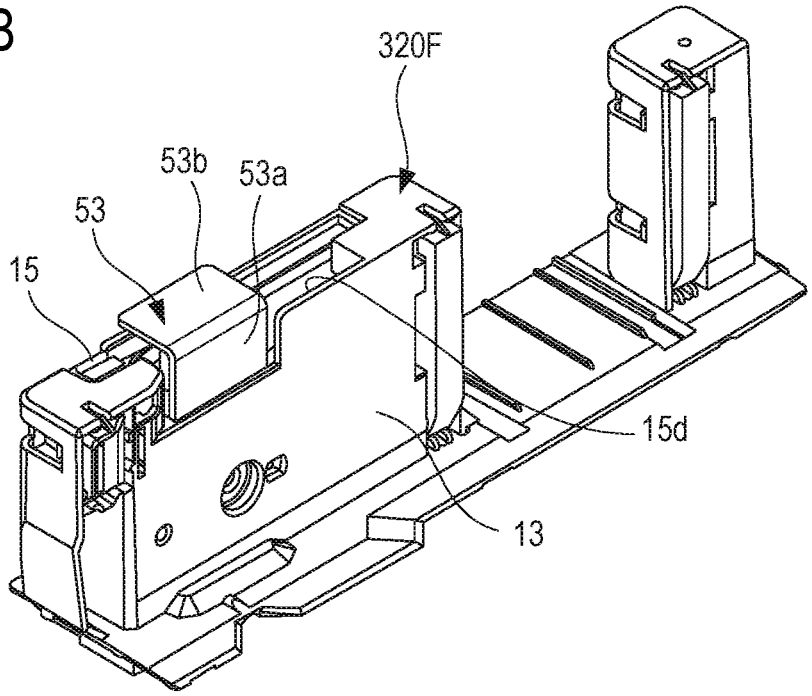
FIG. 11B is a perspective view for illustrating the cover member when being positioned in a proximity position.

As illustrated in FIG. 11A and FIG. 11B, a side edge regulating plate 320F serving as the sheet regulating unit includes the regulating plate main body 15 having a sliding portion 15*d* and the release lever 12. The release lever 12 can pivot along the width direction and the cassette insertion and removal direction between the first position and the second position. A cover member 53 is supported on the sliding portion 15*d* of the side edge regulating plate 320F so as to be movable in a sliding manner in a direction indicated by the arrow E along the sheet feed direction. The cover member 53 is slidable between a proximity position (position illustrated in FIG. 11B) which is in proximity to the release lever 12 and a separate position (position illustrated in FIG. 11A) which is farther from the release lever 12 than the proximity position.

For placing the side edge regulating plate 320F in a movable state with respect to the cassette main body 2 (see FIG. 2A and FIG. 2B), the user positions the cover member 53 in the separate position. For fixing the side edge regulating plate 320F with respect to the cassette main body 2, the user moves the cover member 53 in a sliding manner from the separate position in the direction indicated by the arrow E so as to position the cover member 53 in the proximity position. The cover member 53 has a first surface 53*a* and a second surface 53*b* which extends outward in the width direction from an upper end of the first surface 53*a*. When the cover member 53 is positioned in the proximity position, the first surface 53*a* is opposed to the pressure surface 12*a* of the release lever 12, whereas the second surface 53*b* is opposed to the upper surface 12*d* of the release lever 12.

In this manner, the release lever 12 is covered with the cover member 53 on an upper side, and therefore the user cannot operate the release lever 12. Thus, the user does not erroneously move the side edge regulating plate 320F, and hence the side edge regulating plate 320F can be fixed to the cassette main body 2 with a simple configuration. Further, the cover member 53 remains supported on the regulating plate main body 15 even in a state of being positioned in the separate position, and therefore the cover member 53 is not lost.

The cover member 53 of the third embodiment can be applied to any of the side edge regulating plate having the lock configuration of the first embodiment and the side edge regulating plate having the lock configuration of the second embodiment. Further, the third embodiment is not limited to the configuration of sliding the cover member 53. For example, the release lever 12 may be placed in an operable state and an inoperable state by opening and closing the cover member 53.

Fourth Embodiment

Next, a fourth embodiment of the present invention is described. In the fourth embodiment, the release lever and the lock member are formed integrally. Therefore, an illustration of the same configurations as those of the first embodiment is herein omitted, or the same configurations are denoted by the same reference symbols in the drawings for description.

Figure 12:
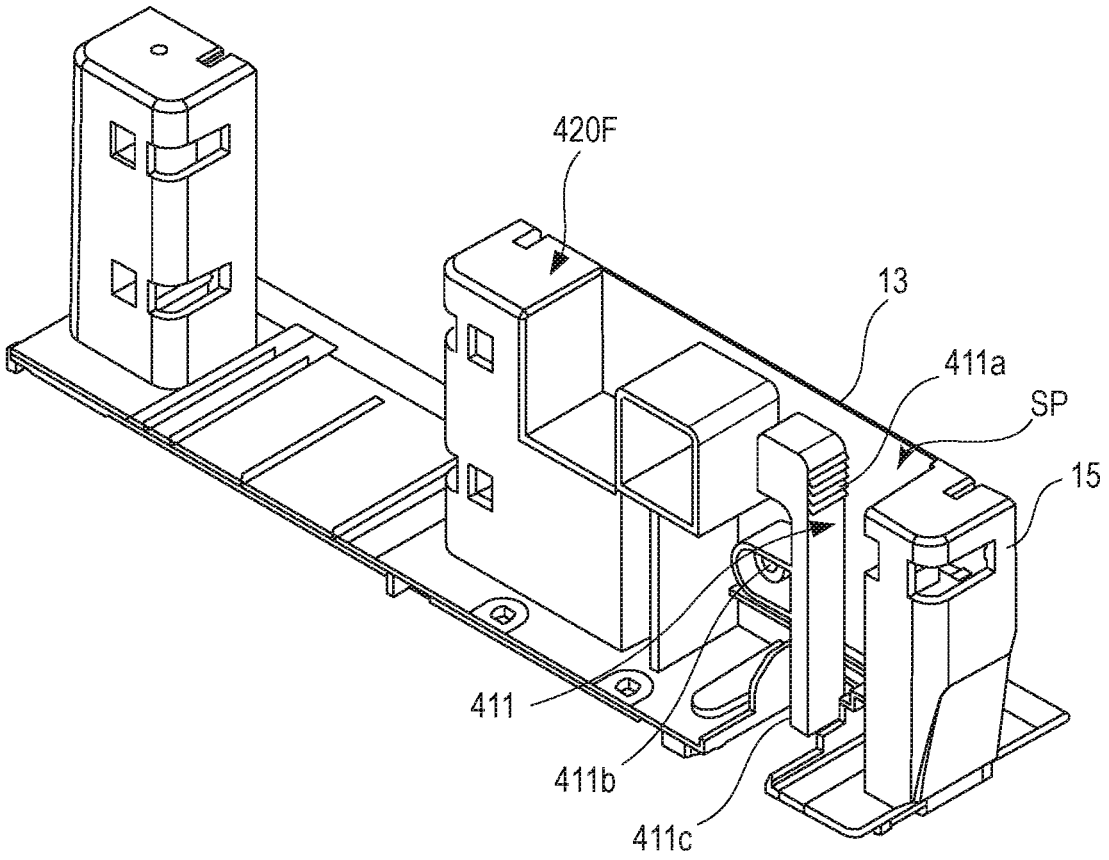
FIG. 12 is a perspective view for illustrating a side edge regulating plate of a fourth embodiment of the present invention.
Figure 13A:
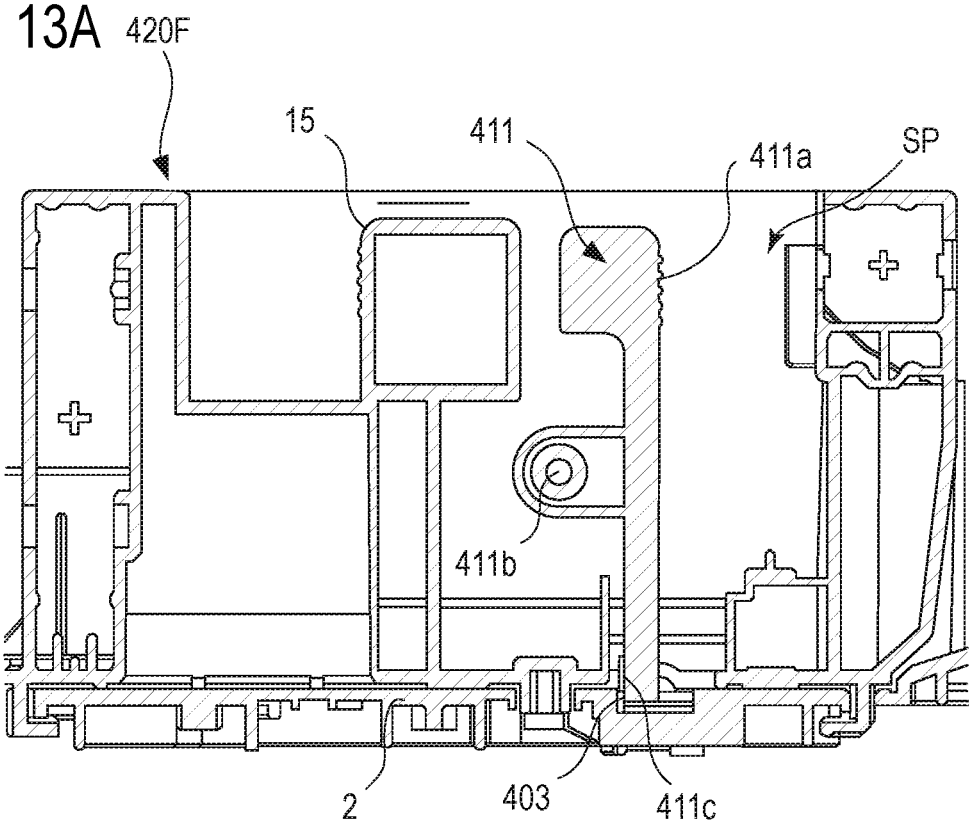
FIG. 13A is a sectional view for illustrating a release lever when being positioned in a first position.
Figure 13B:
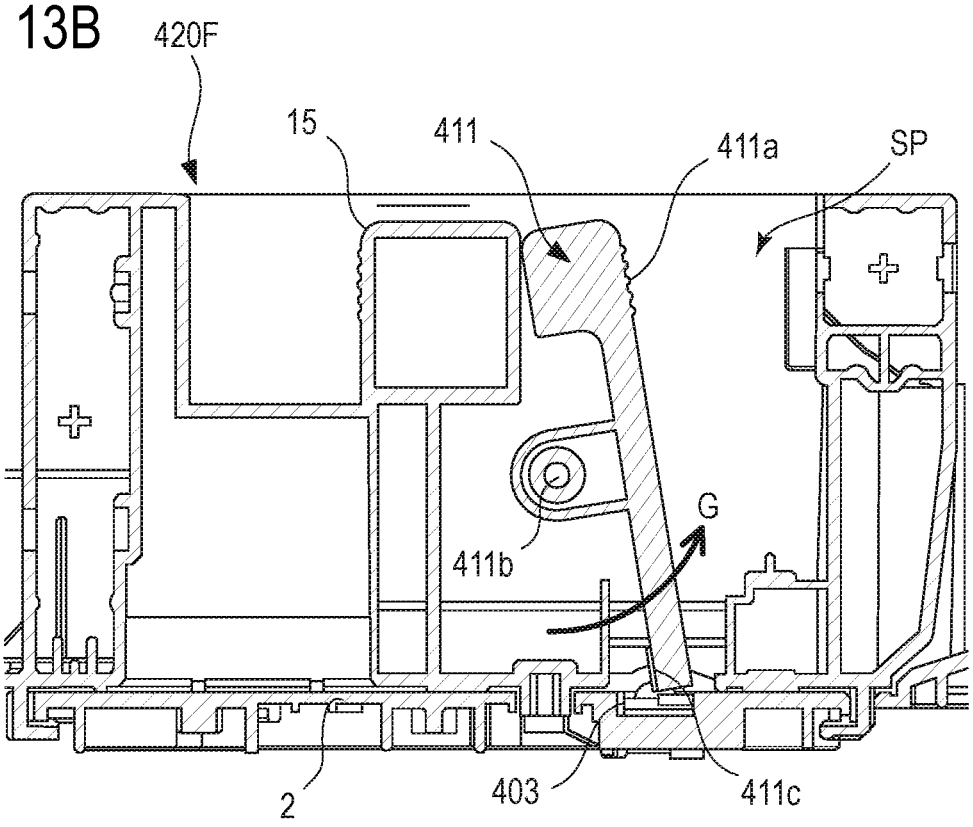
FIG. 13B is a sectional view for illustrating the release lever when being positioned in a second position.

A side edge regulating plate 420F includes, as illustrated in FIG. 12, FIG. 13A, and FIG. 13B, the regulating plate main body 15 serving as a main body, which has the regulating surface 13 to be brought into abutment against the side edge of the sheet to regulate the sheet position, and a release lever 411 which is supported pivotably about a pivoting fulcrum 411*b* as a center with respect to the regulating plate main body 15. The release lever 411 has a pressure surface 411*a* arranged in an upper part and a rack portion 411*c* arranged in a lower part. The rack portion 411*c* can be meshed with a rack portion 403 formed on the cassette main body 2.

The release lever 411 is urged to the first position (position illustrated in FIG. 13A) by a torsion spring (not shown) so that the rack portion 411*c* is meshed with the rack portion 403 of the cassette main body 2. By an operation of pinching the pressure surface 411*a* and the regulating plate main body 15, the user pivots the release lever 411 in a direction indicated by the arrow G to move the release lever 411 to the second position (position illustrated in FIG. 13B) at which the rack portion 411*c* and the rack portion 403 are disengaged from each other. In this manner, the side edge regulating plate 420F becomes movable in the width direction.

Figure 14:
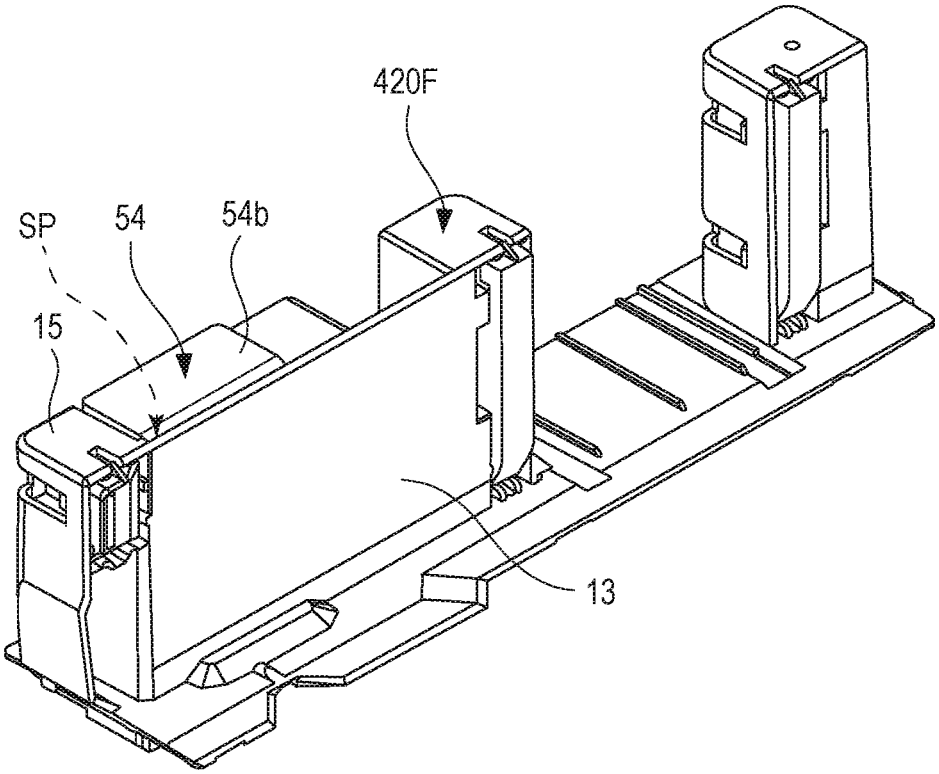
FIG. 14 is a perspective view for illustrating the side edge regulating plate and a cover member.

In the fourth embodiment, as illustrated in FIG. 14, a cover member 54 is provided so as to cover a top of the release lever 411. The cover member 54 is supported on the regulating plate main body 15 so as to be removable therefrom. In general, the user inserts a finger from above into an operation space SP (see FIG. 12) which is positioned in front of the pressure surface 411*a* to operate the pressure surface 411*a*. However, an upper side of the operation space SP is shielded by the cover member 54.

Figure 15:
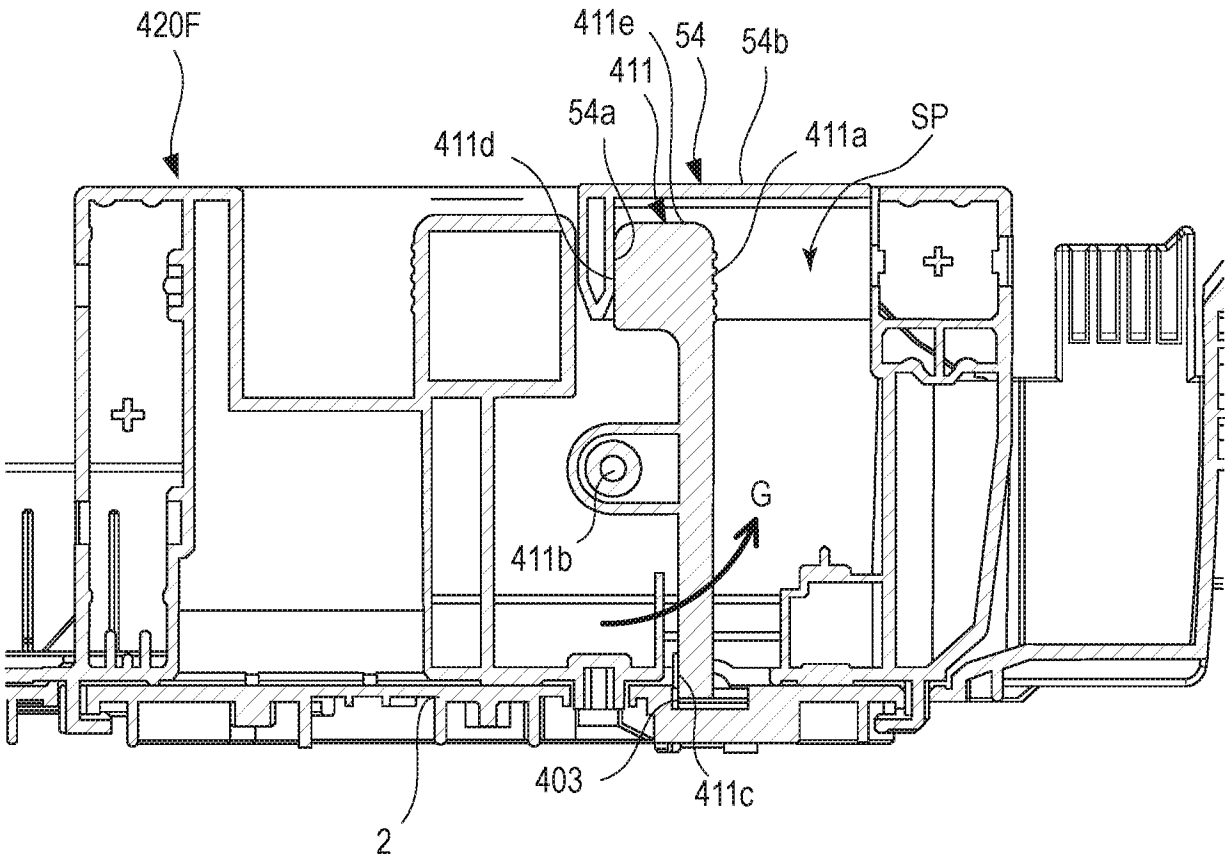
FIG. 15 is a sectional view for illustrating the side edge regulating plate and the cover member.

As illustrated in FIG. 15, the cover member 54 has an abutment surface 54*a* which can be brought into abutment against a side surface 411*d* located on a side opposite to the pressure surface 411*a* and a top surface 54*b* which extends from an upper end of the abutment surface 54*a* in a horizontal direction and is opposed to an upper surface 411*e* of the release lever 411. Under a state in which the cover member 54 is mounted to the regulating plate main body 15, the side surface 411*d* of the release lever 411 and the abutment surface 54*a* of the cover member 54 are held in abutment against each other. Therefore, the movement of the release lever 411 in the direction indicated by the arrow G is regulated, and hence the release lever 411 cannot be moved from the first position to the second position.

The top surface 54*b* of the cover member 54 shields the operation space SP, and therefore the user cannot operate the release lever 411. Further, the abutment surface 54*a* of the cover member 54 regulates the movement of the release lever 411. In this manner, the movement of the side edge regulating plate 420F is reliably regulated, and hence the side edge regulating plate 420F can be fixed to the cassette main body 2 with a simple configuration. Further, the rack portion 411*c* is formed on the release lever 411 to eliminate the lock member. Thus, cost can be reduced.

Although the cover member is provided so as to cover the pressure surface and the upper surface of the release lever in the first to third embodiments, the cover member is not limited thereto. Specifically, when it is difficult for the user to visually recognize and operate the release lever, the pressure surface and the top surface of the release lever are not required to be entirely covered with the cover member. For example, when a 50% or larger region of each of the pressure surface and the top surface is covered with the cover member, it can be said that it is difficult for the user to visually recognize and operate the release lever.

Although the side edge regulating plate which regulates the position of the edge in the width direction of the sheet has been described in each of the embodiments described above, the present invention is not limited to the side edge regulating plate. For example, the present invention may be applied to the trailing edge regulating plate 10 (see FIG. 2A and FIG. 2B). Further, it is apparent that the present invention may be applied to the side edge regulating plate 20R on the far side.

Further, although the electrophotographic printer 201 has been described in each of the embodiments described above, the present invention is not limited thereto. For example, the present invention is applicable to an ink-jet type image forming apparatus which discharges an ink from a nozzle to form an image on a sheet.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-107310, filed May 31, 2017, which is hereby incorporated by reference herein in its entirety.

What is claimed is:

1. A sheet stacking apparatus, comprising:

a sheet stacking unit on which a sheet is to be stacked;

a sheet regulating unit which is movable relative to the sheet stacking unit, the sheet regulating unit including:

a main body having a regulating surface which regulates a position of the sheet stacked on the sheet stacking unit, an operating portion movably supported on the main body and having an operating surface to be operated, the operating portion being moved from a first position to a second position by operating the operating surface, the sheet regulating unit being locked to the sheet stacking unit when the operating portion is in the first position, and the sheet regulating unit being unlocked when the operating portion is in the second position, an engagement member which has an engaging portion engageable with an engaged portion formed in the sheet stacking unit, interlocks with the operating portion, and is movable to a locking position and an unlocking position, the engaging portion being engaged with the engaged portion to lock the sheet regulating unit when the engagement member is in the locking position and the operating portion is in the first position, the engaging portion being disengaged from the engaged portion to unlock the sheet regulating unit when the engagement member is in the unlocking position and the operating portion is in the second position, and an urging member urging the engagement member toward the locking position; and a cover member including a first surface covering the operating surface and a second surface covering an upper surface of the operating portion, the cover member being configured to cover the operating portion with at least the first surface and the second surface so that the operating surface is not visible.

2. The sheet stacking apparatus according to claim 1, wherein the cover member includes a third surface connected to the second surface and opposed to the first surface, and the first surface is connected to the second surface.

3. The sheet stacking apparatus according to claim 1, wherein the cover member has a movement regulating portion capable of preventing movement of the engagement member from the locking position to the unlocking position.

4. The sheet stacking apparatus according to claim 3, wherein the engaged portion and the engaging portion respectively have engagement surfaces which are parallel to a direction of movement of the engagement member.

5. The sheet stacking apparatus according to claim 4, wherein the engaged portion has a first tooth row and a second tooth row which face each other, and wherein the engaging portion has a first rack to be meshed with the first tooth row and a second rack to be meshed with the second tooth row.

6. The sheet stacking apparatus according to claim 5, wherein at least one of the engaged portion and the engaging portion has an inclined surface which is inclined with respect to a direction of movement of the engagement member, and wherein, when the sheet regulating unit is pressed in a direction toward the sheet stacked on the sheet stacking unit with a predetermined pressing force, the inclined surface exerts the pressing force with respect to the engagement member in a direction from the locking position to the unlocking position.

7. The sheet stacking apparatus according to claim 1, wherein the operating portion is movable between the first position and the second position along a direction in which the main body is moved.

8. The sheet stacking apparatus according to claim 1, wherein the sheet regulating unit is a side edge regulating unit which regulates a position of one side edge of the sheet in a width direction perpendicular to a direction of feeding the sheet stacked on the sheet stacking unit, and wherein the sheet stacking apparatus further includes another side edge regulating unit interlocking with the side edge regulating unit and which regulates a position of another side edge of the sheet stacked on the sheet stacking unit in the width direction.

9. The sheet stacking apparatus according to claim 1, wherein the operating portion comprises an operating lever configured to pivot about a pivot shaft between the first position and the second position, and wherein the operating surface is positioned above the pivot shaft.

10. The sheet stacking apparatus according to claim 1, wherein the sheet regulating unit is a trailing edge regulating unit configured to regulate a position of a trailing edge of the sheet stacked on the sheet stacking unit.

11. The sheet stacking apparatus according to claim 1, wherein the operating surface comprises a surface having concavity and convexity.

12. The sheet stacking apparatus according to claim 1, wherein the sheet stacking unit includes a sheet stacking plate on which the sheet is stacked.

13. A sheet stacking apparatus, comprising:

a sheet stacking unit on which a sheet is to be stacked;

a sheet regulating unit which is movable relative to the sheet stacking unit, the sheet regulating unit including:

a main body having a regulating surface which regulates a position of the sheet stacked on the sheet stacking unit, and an operating portion movably supported on the main body and having an operating surface to be operated, the operating portion being moved from a first position to a second position by operating the operating surface, the sheet regulating unit being locked to the sheet stacking unit when the operating portion is in the first position, and the sheet regulating unit being unlocked when the operating portion is in the second position; and a cover member including a first surface covering the operating surface and a second surface covering an upper surface of the operating portion, the cover member being configured to cover the operating portion with at least the first surface and the second surface so that the operating surface is not visible, wherein the cover member includes a locking portion configured to be locked to the main body, the locking portion being pressed into the main body while being elastically deformed.

14. An image forming apparatus, comprising:

an apparatus body;

a feed cassette configured to be drawn out from and inserted into the apparatus body; and an image forming unit provided in the apparatus body and configured to form an image on a sheet fed from the feed cassette, wherein the feed cassette includes:

a sheet stacking unit on which a sheet is to be stacked, a sheet regulating unit which is movable relative to the sheet stacking unit, the sheet regulating unit including:

a main body having a regulating surface which regulates a position of the sheet stacked on the sheet stacking unit, an operating portion movably supported on the main body and having an operating surface to be operated, the operating portion being moved from a first position to a second position by operating the operating surface, the sheet regulating unit being locked to the sheet stacking unit when the operating portion is in the first position, and the sheet regulating unit being unlocked when the operating portion is in the second position, an engagement member which has an engaging portion engageable with an engaged portion formed in the sheet stacking unit, interlocks with the operating portion, and is movable to a locking position and an unlocking position, the engaging portion being engaged with the engaged portion to lock the sheet regulating unit when the engagement member is in the locking position and the operating portion is in the first position, the engaging portion being disengaged from the engaged portion to unlock the sheet regulating unit when the engagement member is in the unlocking position and the operating portion is in the second position, and an urging member urging the engagement member toward the locking position, and a cover member including a first surface covering the operating surface and a second surface covering an upper surface of the operating portion, the cover member being configured to cover the operating portion with at least the first surface and the second surface so that the operating surface is not visible.

* * * * *